US005552647A

United States Patent [19]

Tinkham

[11] Patent Number: 5,552,647

[45] Date of Patent: Sep. 3, 1996

[54] POSITION-SENSING DEVICE FOR POWER DISTRIBUTION SWITCH

[75] Inventor: Ronald B. Tinkham, Solana Beach, Calif.

[73] Assignee: Systems Analysis and Integration, Inc., Orange, Calif.

[21] Appl. No.: 226,650

[22] Filed: Apr. 12, 1994

[51] Int. Cl.[6] ..... H01H 35/02

[52] U.S. Cl. ..... 307/119; 307/111; 340/686; 361/139; 361/154; 200/17 R; 200/51 R; 200/51.09; 200/51.1

[58] Field of Search ..... 307/119, 111; 340/686; 361/152–210, 139; 200/51 R, 51.09, 51.1, 17 R

[56] References Cited

U.S. PATENT DOCUMENTS

| | | | |
|---|---|---|---|
| 3,076,081 | 1/1963 | Oppel . | |
| 3,233,071 | 2/1966 | Buzzell . | |
| 3,493,952 | 2/1970 | Jette . | |
| 3,555,226 | 1/1971 | Spindle . | |
| 3,594,525 | 7/1971 | Miller et al. . | |
| 3,662,128 | 5/1972 | Neudorfer et al. . | |
| 3,806,682 | 4/1974 | Mauthe et al. . | |
| 3,925,722 | 12/1975 | Fohrhaltz et al. . | |
| 4,027,125 | 5/1977 | Peek et al. . | |
| 4,051,340 | 9/1977 | Wolski . | |
| 4,357,505 | 11/1982 | Bridges | 200/48 |
| 5,321,980 | 6/1994 | Hering et al. . | |

OTHER PUBLICATIONS

RACO International Corp. Adverttising Brochure–Potentiometer and Activator Housing.

Photograph of Stainless Steel Enclosure, Systems Integrated, San Diego, CA.

Maurey Engineering Manual, Maurey Instrument Corp., Chicago, IL Brochure of LINAK Actuator, Model LA38, distributed by RACO International, Inc., Bethel Park, PA.

*Primary Examiner*—William M. Shoop, Jr.
*Assistant Examiner*—Albert Paladini
*Attorney, Agent, or Firm*—Knobbe, Martens, Olson & Bear

[57] ABSTRACT

A remotely controlled actuator assembly is provided to switch a large power distribution switch used in an electrical utility power grid. The actuator of the assembly throws the switch between at least two positions to establish at least two power routing conditions. The actuator assembly includes a position-sensing device to repeatably and accurately indicate the position of the actuator. The position-sensing device generates a signal indicative of the extent of displacement of the actuator. The generated signal provides feed-back to a control system which control the extent of actuator travel.

21 Claims, 8 Drawing Sheets

POSITION-SENSING DEVICE FOR POWER DISTRIBUTION SWITCH

BACKGROUND OF THE INVENTION

1. Field of the Invention

The present invention relates in general to an automated control system for a power distribution switch, and in particular to a sensing mechanism for determining switch position.

2. Description of Related Art

Several power utility companies have recently employed automated power grid networks to redistribute or reroute electricity throughout service areas. These power companies reroute electrical power via power distribution switches located throughout a city or a community. Remotely controlled actuators, which are attached to the switches, selectively throw the switches to reroute the power.

These switches are a key part of the power grid as they allow for the rerouting of power around problem areas. The actuation of these switches, when called upon, is very critical. Blackouts and brownouts can occur if the automated system does not operate properly.

An actuator and its enclosure are normally mounted on the top or side of the power distribution switch. A shaft of the actuator is coupled to a lever of the distribution switch. Movement of the actuator shaft moves the lever to throw the switch.

The actuator shaft and the coupled lever commonly reciprocate between an open position and a closed position. In the open position the switch establishes a first power routing condition, and in the closed position the switch establishes a second power routing condition.

A central control system controls the switches of the power grid, and hence, controls the distribution of power throughout the associated service area. The central control system communicates with remote terminal units, each of which directly controls several switch actuators. The remote terminal unit selectively powers a specific switch actuator when instructed to do so by the central control system.

Limit switches communicate with the remote terminal unit to control the extent of actuator travel. Specifically, the limit switches establish "stops" (i.e., the point at which the actuator's travel stops).

Prior limit switches have been used in conjunction with triggering mechanisms which trip the limit switches at predefined points along the length of the actuator travel. Such trigger mechanisms generally have been adjustable so that the points at which the mechanism trips the corresponding limit switches can be varied along the length of the actuator travel. The triggering mechanism thus allows for the stops of the actuator to be adjusted to define specific stroke lengths of the actuator.

When the central control system signals a particular remote terminal unit to switch a specific power distribution switch, the remote terminal unit connects an electric motor of the actuator to a source of power. The electric motor drives the actuator shaft in the desired direction to move the lever and throw the switch to establish a desired power routing condition. At the position where the actuator throws the switch, the triggering mechanism attached to the actuator trips the limit switch, which in turn communicates with a power supply of the remote terminal unit to stop the actuation of the switch actuator.

SUMMARY OF THE INVENTION

The ability to determine the position of the actuator shaft is important to assure that the switch has been thrown and to turn off the actuator motor. However, it has been determined that the prior limit switch assemblies (i.e., the limit switches and the associated triggering mechanism) fail to provide the accuracy and repeatability necessary to properly control the distribution switch. This is because prior triggering mechanisms generally are difficult to accurately adjust.

Moreover, it has been found that these mechanism are not reliable over time because the components of these mechanisms often cohere due to rust and corrosion if the corresponding actuator remained stationary for a significant period of time. Consequently, the limit switch assemblies often do not accurately and repeatable track actuator displacement.

Prior limit switch assemblies also are overly complicated and thus costly.

A need therefore exists for a position-sensing device which is simply structured and provides an accurate and repeatable indication of the linear position of the actuator over its stroke.

One aspect of the present invention is adapted to be embodied in an actuator assembly for use with a power distribution switch of the type used with an electrical utility power grid. The actuator assembly includes an actuator having a body and a movable member. The movable member is adapted to be coupled to a lever of the power distribution switch and is movable relative to the body between at least a first position and a second position. The movable member, when in the first position, positions a lever of the power distribution switch to establish a first power routing condition. When in the second position, the movable member positions the lever of the power distribution switch to establish a second power routing condition. The movable member also carries a reference member.

The actuator assembly also includes a position-sensing device that is attached to the actuator. The position-sensing device generates a signal indicative of movement of the reference member, as the movable member moves between the first and second positions.

In a preferred embodiment, the position-sensing device generates a signal indicative of the extent of displacement of the reference member relative to the actuator body. The position-sensing device desirable comprises a linear potentiometer which extends between the actuator body and the reference member.

In accordance with a preferred method of controlling the position of a power distribution switch, the method involves the step of coupling an actuator shaft to the power distribution switch. A reference member is attached to the actuator shaft so as to move with the actuator shaft. Movement of the reference member is detected as the actuator shaft moves the lever of the switch. A signal which is indicative to the movement of the reference member is then generated to indicate the position of the reference member, and hence the actuator shaft. This signal is communicated to control circuitry.

BRIEF DESCRIPTION OF THE DRAWINGS

These and other features of the invention will now be described with reference to the drawings of a preferred embodiment which is intended to illustrate and not to limit the invention, and in which.

DETAILED DESCRIPTION OF A PREFERRED EMBODIMENT

Figure 1:
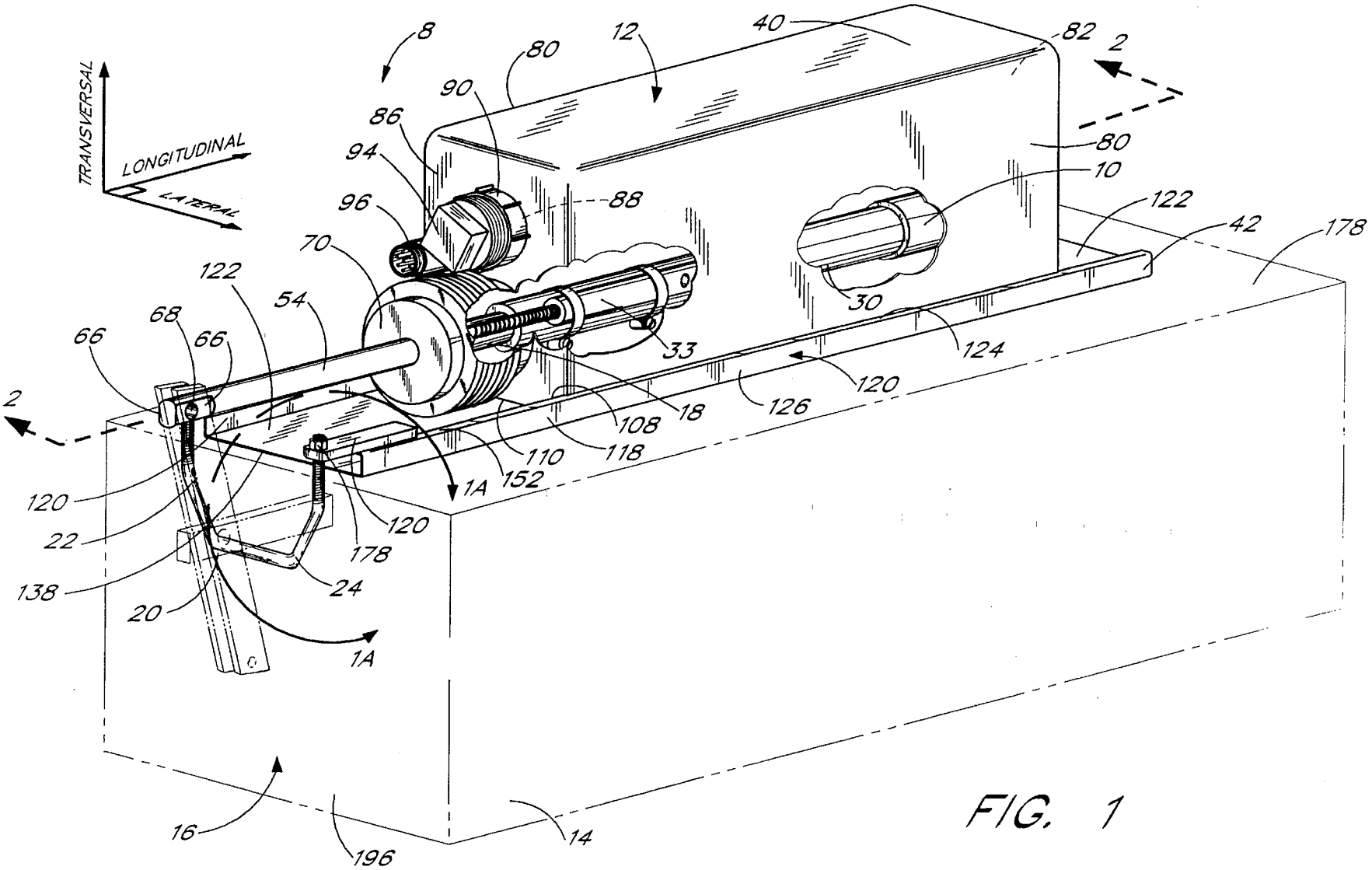
FIG. 1 is a front perspective view of an actuator housing assembly in accordance with a preferred embodiment of the present invention.

FIG. 1 illustrates an actuator assembly 8 configured in accordance with a preferred embodiment of the present invention. The actuator assembly 8 includes an actuator 10 housed within a housing 12. The housing 12 is attached directly to a box 14 of a conventional power distribution switch 16 (e.g., a Joslyn SF6 Switch), preferably to the top of the box 14. Mounting attachments, such as a forward clamp 24 and/or a rear mount 26 (see FIG. 5) may be used to attached the housing 12 to the box 14.

An actuator rod 18, which extends out the front of the housing 12, connects to a lever 20 of the power distribution switch 16 via a linkage 22. In the illustrated embodiment, the actuator rod 18 retracts to move the lever 20 into a closed position (see FIG. 8A) and extends to move the lever 20 into an open position (see FIG. 8B). Of course, it is understood that the actuator rod 18 could retract to establish an open switch position and extend to establish a closed switch position. Additionally, it is contemplated that multiple power routing conditions (i.e., multiple contacts) also could be established at multiple positions along the stroke of the actuator rod 18.

Figure 2:
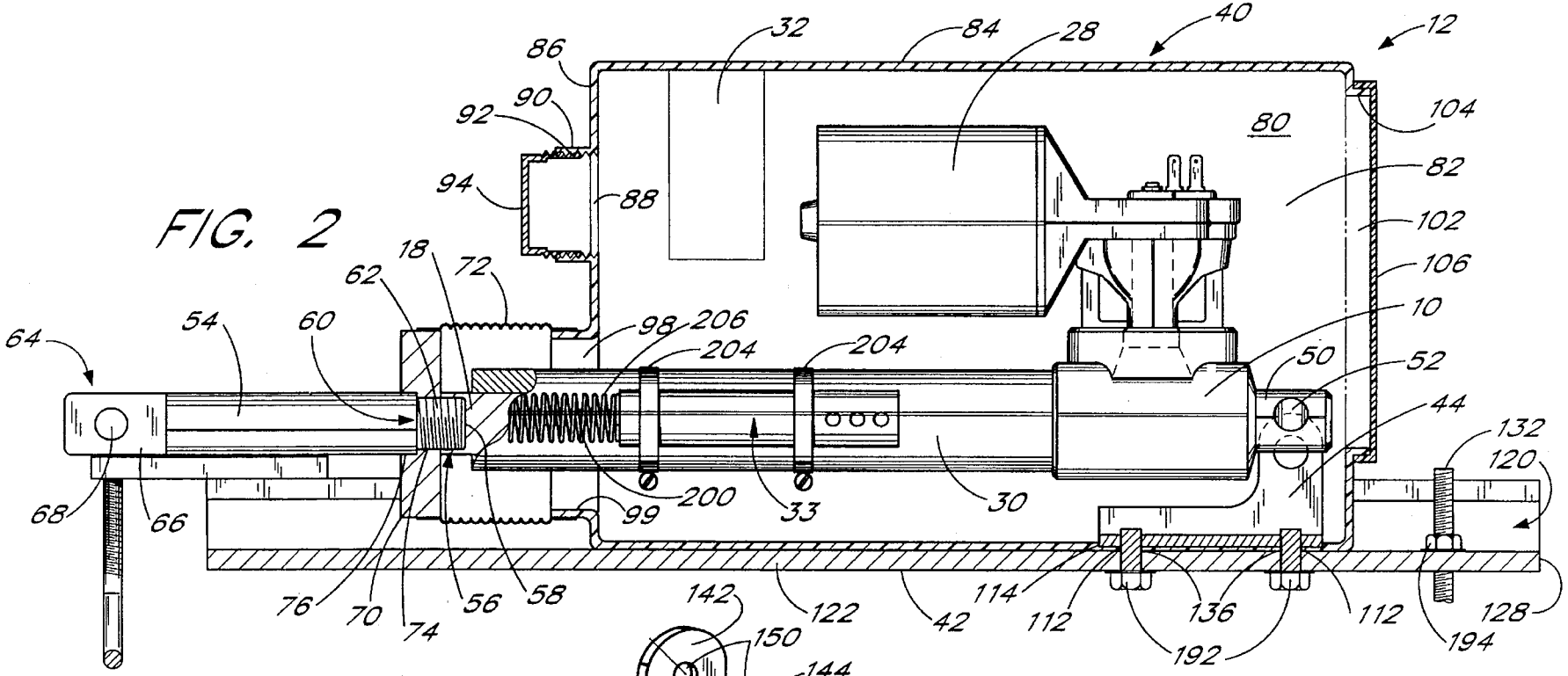
FIG. 2 is a cross-sectional view of the actuator housing assembly taken along line 2—2 of FIG. 1.

As best seen in FIG. 2, the housing 12 encloses at least a portion of the actuator 10, and preferably encloses an electrical motor 28 and a cylindrical body 30 of the actuator 10. Advantageously, the housing 12 generally hermetically seals the actuator 10 within the housing 12 to protect the actuator 10 against damage caused by flooding or by dirt, grime or caustic elements.

The housing 12 may include a control card which controls the extent of displacement of the actuator 10. As discussed below, a control card 32, together with a position-sensing device 33, form a control system 35 (see FIG. 9) which accurately and repeatedly positions the actuator.

FIG. 1 illustrates the housing 12, which principally comprises a hollow enclosure 40 and a strong back 42 attached to the enclosure 40. The strong back 42 is interposed between the enclosure 40 and the distribution switch box 14 when the housing 12 is attached to the switch box 14. A bracket 44, as seen in FIG. 2, supports the actuator 10 within the housing 12 and is connected to the strong back 42.

The strong back 42 and bracket 44 are designed to carry the resultant stresses produced when the actuator 10 is actuated. In this manner, the enclosure 40 is generally isolated from the resultant stresses. The enclosure 40 principally serves to enclose the actuator from the environment within the vault. Thus, the enclosure can be formed of plastic or other light weight material to minimize the weight of the enclosure and to reduce manufacturing costs.

FIG. 1 illustrates a longitudinal axis, a transverse axis and a lateral axis in relation to the actuator housing 12 to facilitate the following description. Additionally, as used herein, "the longitudinal direction" refers to a direction substantially parallel to the longitudinal axis. "The lateral direction" and "the transverse direction" are likewise in reference to the lateral axis and transverse axis, respectively. Also, "front" and "rear" are in reference to the proximity of the distribution switch lever 20 (see FIG. 1). The individual components of the housing 12/actuator 10 assembly will now be described in detail.

THE ACTUATOR

FIG. 2 best illustrates that the actuator 10 preferably comprises a screw drive linear actuator, such as the type commercially available from Warner Electric of Dana Point, Calif. However, although the actuator 10 is described and illustrated in terms of a linear actuator, it is contemplated that other types of actuators, such as, for example, a rotational actuator, could be used as well with the housing 12. The linear actuator 10 comprises the actuator rod 18 slidably positioned within the cylinder 30. The electric motor 28 drives the actuator rod 18 back and forth in the longitudinal direction.

The actuator 10 also includes a rear, stationary support stud 50 which is used to fix the rear end of the actuator 10. The support stud 50 defines an aperture 52 with an axis positioned generally perpendicular to the longitudinal axis of the actuator 10.

An extender 54 desirably attaches to a forward end 56 of the actuator rod 18, preferably by a screw connection. That is, the forward end 56 of the actuator rod 18 includes a threaded bore 58 and the rear end 60 of the extender 54 includes a correspondingly threaded stud 62. The extender 54 desirably has a cylindrical shape of a diameter substantially equal to that of the actuator rod 18. The forward end 64 of the extender 54 has a pair of diametrically opposed flat surfaces 66 and an aperture 68 which extends between the flat surfaces 66, through the extender 54 and generally in the lateral direction.

As best seen in FIG. 2, an annular collar 70 is interposed between the extender 54 and the actuator rod 18. The collar 70 has a diameter sized to support a forward end of a bellow 72, as discussed in detail below.

The collar 70 includes a central aperture 74 with a counter bore 76 circumscribing the central aperture 74. The central aperture 74 is sized to receive the threaded stud 62 of the extender 54 and the counter bore 76 is sized to receive a portion of the cylindrical extender 54 adjacent to the threaded stud 62. When assembled, the extender 54 secures the collar 70 to the forward end 56 of the actuator rod 18.

THE ENCLOSURE

FIG. 1 illustrates that the enclosure 40 generally has a rectangular box shape formed in part by opposing, rectangular-shaped side walls 80. However, as will be readily appreciated by one skilled in the art, enclosures incorporating the present invention can be manufactured in any of a wide variety of sizes and configurations, in addition to the one disclosed herein, depending upon the specific application of the housing 12.

Within the sidewalls 80, the enclosure 40 defines an internal cavity 82 sized to receive at least a portion of the actuator 10. As best seen in FIG. 2, the electric motor 28 and the actuator cylinder 30, as well as the control card 32, preferably fit within the internal cavity 82. A bolt or rivet (not shown) secures the control card 32 inside the enclosure 40, preferably to a top panel 84 of the enclosure 40, proximate to a front panel 86.

FIG. 1 illustrates that the front panel 86 of the enclosure 40 preferably has a flat, generally rectangular shape and defines an aperture 88 of sufficient size to allow access to the control card 32 mounted inside the enclosure 40. An annular flange 90 circumscribes the aperture 88 and extends forward from the front panel 86 of the enclosure 40. The flange 90 includes internal thread 92 (see FIG. 2), preferably in accordance with the National Pipe Thread standard. A plug 94, having corresponding external threads, inserts into the annular flange 90 to seal the aperture 88. The plug 94 is preferably a conventional clean-out-type plug available commercially from McMaster-Carr of Los Angeles, Calif.

FIG. 1 also illustrates that the front panel 86 supports an electrical connector 96 for power and control communication input. The connector 96 is adapted to engage a corresponding receptacle connector to connect the electronics inside the enclosure 40 with a source of electrical power and a modem line, such that the control card 32 communicates with the central control system. Preferably, the connector 96 is a pin-type connector, commercially available McMaster-Carr. Internal wiring (not shown) connects the connector 96 to the control card 32 (see FIG. 2) and to the electrical motor 28 of the actuator 10. The connector 96 sits against the enclosure front panel 86 and is preferably sealed against the panel 86 by a washer, an O-ring, a rubberized, insulation-type, silicon caulking, or the like.

As best seen in FIG. 2, the front panel 86 further includes a central opening 98 for the actuator rod 18. The central opening 98 preferably has a generally circular shape of a diameter larger than that of the actuator cylinder 30. An annular flange 99 circumscribes the central opening 98 and extends in the longitudinal direction away from the front panel 86. The flange 99 desirably has a longitudinal width of sufficient size to support a connector, such as, for example, a hole clamp (not shown), which is used to secure the bellow 72 to the enclosure 40, as discussed below. An outer diameter of the annular flange 99 preferably matches that of the annular collar 70 attached to the actuator rod 18.

Figure 3:
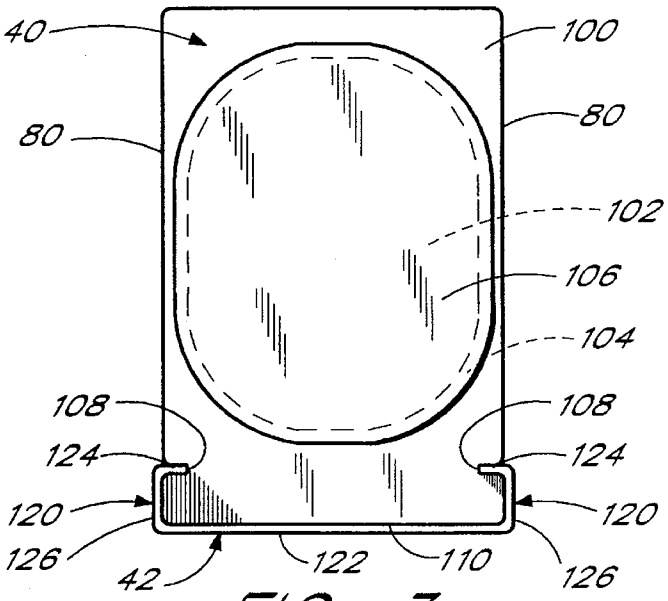
FIG. 3 is a rear elevational view of the actuator housing assembly of FIG. 1.

FIG. 3 illustrates a rear panel 100 of the enclosure 40 which defines an opening 102. The opening 102 provides access into the internal cavity 82 of the enclosure 40 to facilitate installation and removal of the actuator 10 and the internal electronics. The opening 102 preferably has an oval or elliptical shape. It has been found that such shape provides a superior seal over other shapes having a sufficient size for the actuator to pass through. That is, the oval shape has proven beneficial in holding a seal. It is contemplated, however, that other shape can be used as well, depending upon the specific application of the enclosure 40. A flange 104 (see FIG. 2 and 3) circumscribes the access opening 102 and projects outwardly, away from the internal cavity 82 of the enclosure 40.

As seen in FIGS. 2 and 3, the enclosure 40 includes a removable rear cap 106 which covers the access opening 102 of the rear panel 100. The cap 106 has a corresponding shape to that of the opening 102 and snugly fits over the flange 104. A hose clamp (not shown) may be used to secure the cap 106 onto the flange 104. It is contemplated, however, that other types of attachment means, such as, for example, interlocking grooves and ribs on the cap 106 and flange 104, can be used as well to secure the cap 106 to the enclosure 40.

As illustrated in FIGS. 1 and 3, each side wall 80 defines a longitudinal groove 108 which extends along the length of side wall 80 proximal to a bottom panel 110 of the enclosure 40. Each side wall 80 juts into the internal cavity 82 to form the groove 108 on its exterior side. The groove 108 has a depth, as measured in the lateral direction, sized to receive a portion of the strong back 42 to attach the strong back 42 to the enclosure 40, as discussed below.

The grooves 108 desirably oppose each other and are coextensive with the side walls 80 in the longitudinal direction. The position of the grooves 108 above the bottom surface 110 is desirably selected to coincide with the height, as measured in the transverse direction, of the strong back 42.

As best seen in FIG. 2, the bottom panel 110 defines a pair of through holes 112. The through holes 112 are positioned proximate to the rear panel 80 of the enclosure 40 and are generally aligned with each other in the longitudinal direction. More preferably, the holes 112 are aligned in the longitudinal direction with the axis of the central opening 96 of the front panel 86.

About the through holes 112, the enclosure bottom 108 defines a recess 114 sized receive a portion of the bracket 44. The recess 114 preferably has a shape similar to that of a base 140 of the bracket 44 (discussed in detail below) so as to generally orientate the bracket 44 within the interior cavity 82 when assembled.

The enclosure 40 is preferably rotationally molded of a hardened plastic, such as, for example, a low-density linear polyethylene, available commercially as PAXON 198 from Allied Signal, as MARLEX 198 from Phillips Chemical, or as #636 from Novacor. It is contemplated, however, that other materials, such as, for example, composite materials or other plastics with or without fillers and laminates, could be used as well. Additionally, those skilled in the art will appreciate that the enclosure 40 can also be constructed by blow molding, injection molding, transfer molding, vacuum molding or similar methods known or developed in the art. The enclosure 40 preferably has a generally uniform thickness which is less than ½ inch (1.5 cm) and more preferably equals about ⅛ inch (0.03 cm).

STRONG BACK

Figure 4:
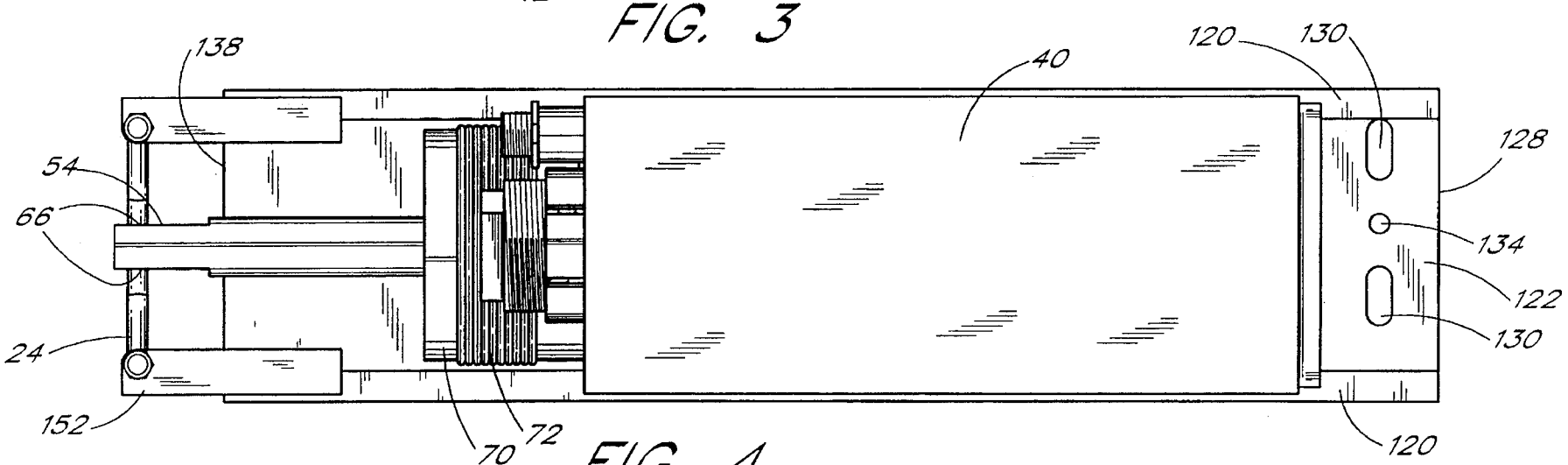
FIG. 4 is a top plan view of the actuator housing assembly of FIG. 1.

FIGS. 1, 3 and 4 best illustrate the strong back 42. The strong back 42 comprises a pair of opposing side rails 120 supported by a rectangular base plate 122. Each rail 120, as seen in FIG. 3, has an inverted "L" shape and is attached to the longitudinal sides of the base plate 122. An upper horizontal member 124 of the rail 120 extends towards the center of the strong back 42 and is attached to a vertical member 126. The vertical member 124 attaches to the base and, as seen in FIG. 1, extends along the length of the base plate 122.

The vertical member 126 has a height selected to prevent the base plate 122 from bending when subjected to the moment produced when the actuator is actuated. That is, the height of the vertical member 126 is chosen to sufficiently increase the moment of insertion (I) of the strong back 42 to carry the resultant bending moment produced when the actuator 10 throws the power distribution switch 16. In an exemplary embodiment for use with a Joslyn SF6 switch, in which the resultant force on the housing 12 is as much as 1000 pounds, the height of the vertical members 126 is preferably about ¾ inch (1.9 cm). It is contemplated, however, that the height of the vertical number 126 can readily be selected by those skilled in the art to suit specific strength requirement of a given application.

FIG. 3 illustrates that the base plate 122 has a width defined between the rails 120 generally equal to the width of the enclosure bottom panel 110. The length of the base plate 120 is generally equal to a distance between the front surface 196 of the switch box 14 and a pair of conventional mounting studs (see FIG. 2) positioned on the top of the box 14. For instance, in an exemplary embodiment, for use with a Joslyn SF6 switch, the length of the base plate 122 is desirably 20.5 inches (52 cm). However, the length of the base plate 122 can readily be customized to suit the specific size of switch box 14.

As best seen in FIG. 4, the base plate 122 defines at least one mounting aperture positioned proximate to a rear edge 128, and more preferably defines a pair of slots 130 positioned to generally coincide with the position of the mounting studs 132 (see FIG. 2) on an upper surface 178 of the switch box 14. As illustrated in FIG. 4, the slots 130 extend in the lateral direction to compensate for variations in position of the mounting studs 132. The base plate 122 may also include a hole 134 used to attach the rear mount 26 to the base plate 122, as discussed below.

FIG. 2 illustrates that the base plate 42 includes a pair of holes 136 which desirably correspond to the through holes 112 of the enclosure bottom panel 110. That is, the holes 136 of the base plate 42 generally align with the through holes 112 of the enclosure bottom panel 110. The holes 136 preferably lie along the longitudinal axis of the strong back 42. The base plate holes 136 are positioned forward of the slots 130 and sufficiently distanced therefrom such that, with the holes 136 aligned with the enclosure through holes 112, the slots 130 remain exposed (i.e., the enclosure 40 does not cover the slots 130).

The strong back 42 is desirably stamped from a sheet of rigid material having a sufficiently large yield strength to withstand the stresses and moments placed upon the strong back 42 as a result of actuator actuation. The strong back 42 is preferably formed of a metal or metal alloy, and is more preferably formed of a corrosion-resistant metal alloy, such as, for example, 11 GA PL Stainless Steel. The strong back 42 can also be fabricated by other known or developed method which would be apparent to one skilled in the art. Additionally, as those skilled in the art will readily appreciate, the strong back can alternatively be formed of any of a variety of composite materials which have the required strength and rigidity properties.

BRACKET

Figure 2A:
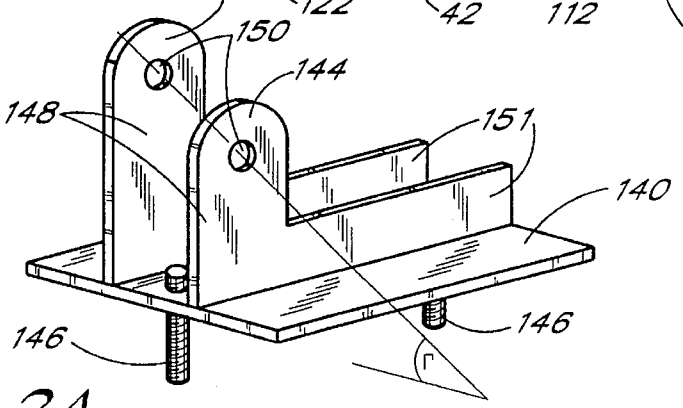
FIG. 2A is a top perspective view of a bracket of the actuator housing assembly of FIG. 2.

FIG. 2A illustrates the bracket 44 used to fixedly support the support stud 50 of the actuator 10. The bracket 44 comprises a base 140 supporting a pair of generally parallel, upstanding legs 142, 144. Two studs 146, preferably threaded, extend from the bottom of the base 140. The studs 146 are used to attach the bracket 44 to the base plate 122 of the strong back 42, as discussed below. The studs 146 are preferably symmetrically positioned between the legs 142, 144, as well as positioned along the longitudinal axis of the base 140. The studs 146 are desirably welded to the base 140, but preferably only on the top side of the base 140. It is understood, however, that the studs 146 could attach to the base 140 by similar means.

The base 140 preferably has a generally rectangular, plate-like shape of a sufficient size to stabilize the bracket 44 when the actuator 10 acts against the bracket 44. In an exemplary embodiment for use with a Joslyn SF6 switch, in which the resultant force applied to the bracket 44 is as much as 1,000 pounds, the base 140 of the bracket 44 preferably has a width, as measured in the lateral direction, of about 3.0 inches (7.6 cm) and a length, as measured in the longitudinal direction, of about 3.5 inches (8.9 cm). The thickness of the base 140, as measured in the transverse direction, is preferably 3/16 inch (0.5 cm). It is contemplated, however, that the size of the base 140 can readily be selected by those skilled in the art to suit the specific strength requirement of a given application.

Each leg 142, 144 generally has an "L" shape. An upper portion 148 of each leg 142, 144 has a rounded end and defines an aperture 150. A lower portion 151 of each leg 142, 144 attaches to the base 140 and extends along the length of the base 140. The legs 142, 144 are preferably welded to the base 140.

The first leg 142 desirably has a transverse height greater than that of the second leg 144 so that the corresponding apertures 150 are misaligned in the transverse direction. That is, an axis extending between the apertures 150 is skewed relative to the base 140. As discussed more fully below, the axis is skewed from the base by a sufficiently oblique angle $\Gamma$ to tilt the actuator 10 to one side and thus reduce the overall transverse height of the actuator 10/bracket 44 assembly. In an exemplary embodiment, the oblique angle $\Gamma$ of the axis preferably ranges between 5° and 25°, and more preferable equals about 15°.

The bracket 44 is desirably formed of a rigid material having a sufficiently large yield strength to withstand the stresses and moments placed upon it as a result of actuator actuation. The bracket 44 is preferably formed of a metal or metal alloy, and is more preferably formed of a corrosion-resistant alloy, such as, for example, 11 GA PL Stainless Steel. However, as those skilled in the art will readily appreciate, the bracket 44 can alternatively be formed of any of a variety of composite materials which have the required strength and rigidity properties.

MOUNTING ATTACHMENTS

Figure 1A:
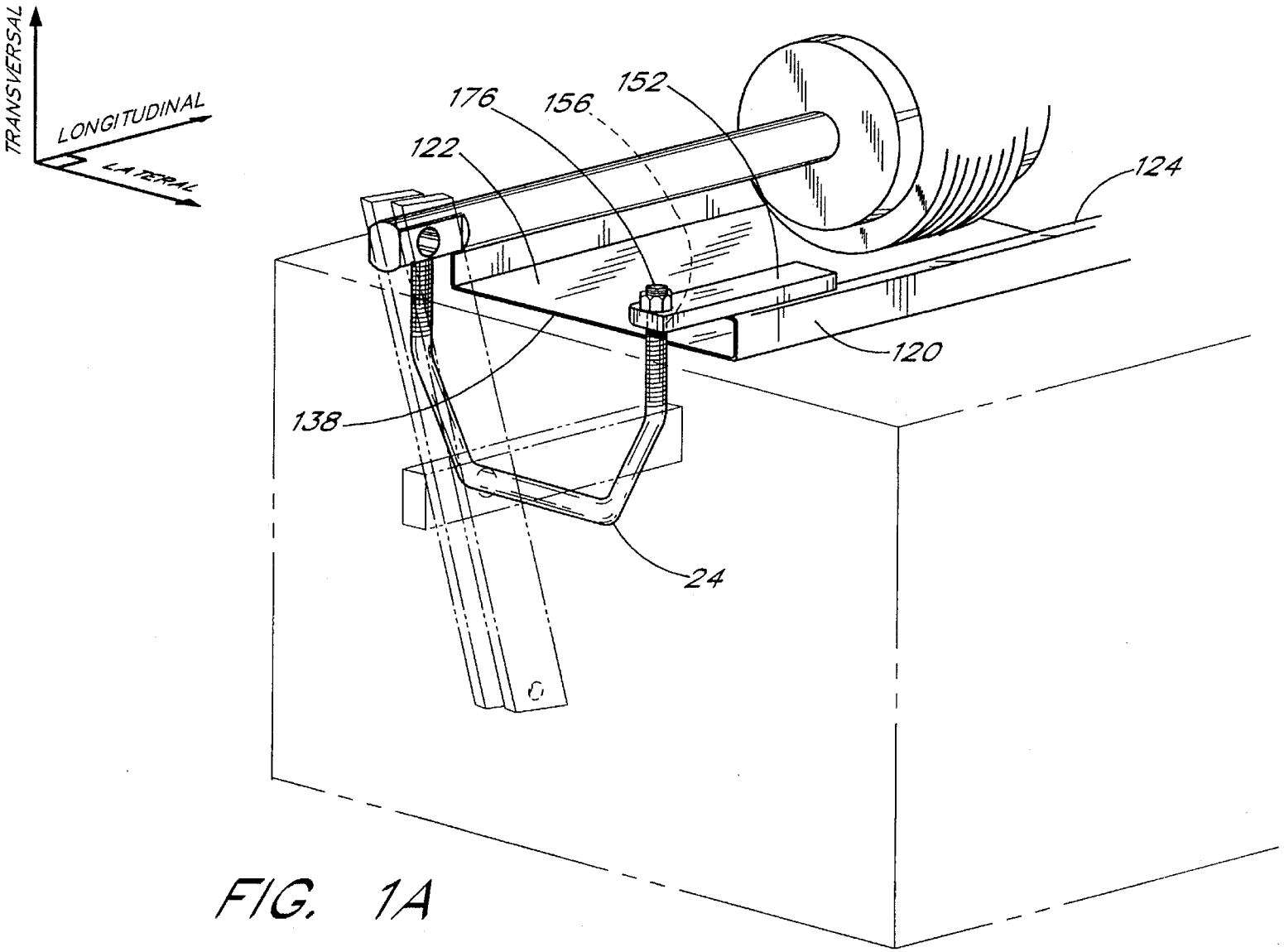
FIG. 1A is an enlarged perspective view of the area within line 1A—1A of FIG. 1 illustrating a front mounting attachment of the actuator housing assembly.

The front mounting attachment comprises the clamp 24 suspended from a pair of support arms 152. FIG. 1A illustrates an exemplary embodiment in which each support arm 152 is attached to the strong back rails 120. It is contemplated that the position at which the support arm 152 is attached to the strong back 42 will depend upon the specific application of the housing 12, and may be readily ascertained by those skilled in the art.

As seen in FIG. 1A, each support arm 152 desirably has a generally rectangular shape. The forward end of the support arm includes a hole 156.

In the illustrated embodiment, each support 152 arm is attached to the horizontal member 124 of the corresponding strong back rail 120. It is preferred that the support arms 152 are welded to the strong back rails 120; however, it is contemplated that the support arms 152 could be attached to the strong back by screws or other known means as well. When assembled, each support arm 152 extends beyond the front edge 138 of the strong back 42.

FIG. 1A illustrate the clamp 24. In the illustrated embodiment, the clamp 24 is a U-shaped bolt with threaded ends. Each end of the U-shaped clamp 24 extends through the hole 156 of the corresponding support arm 152. Nuts 176 secures the threaded ends of the clamp 24 to the support arms 152. In this manner, the clamp 24 is suspended from the from the support arms 152 to capture a portion of the switch lever 20.

Figure 5:
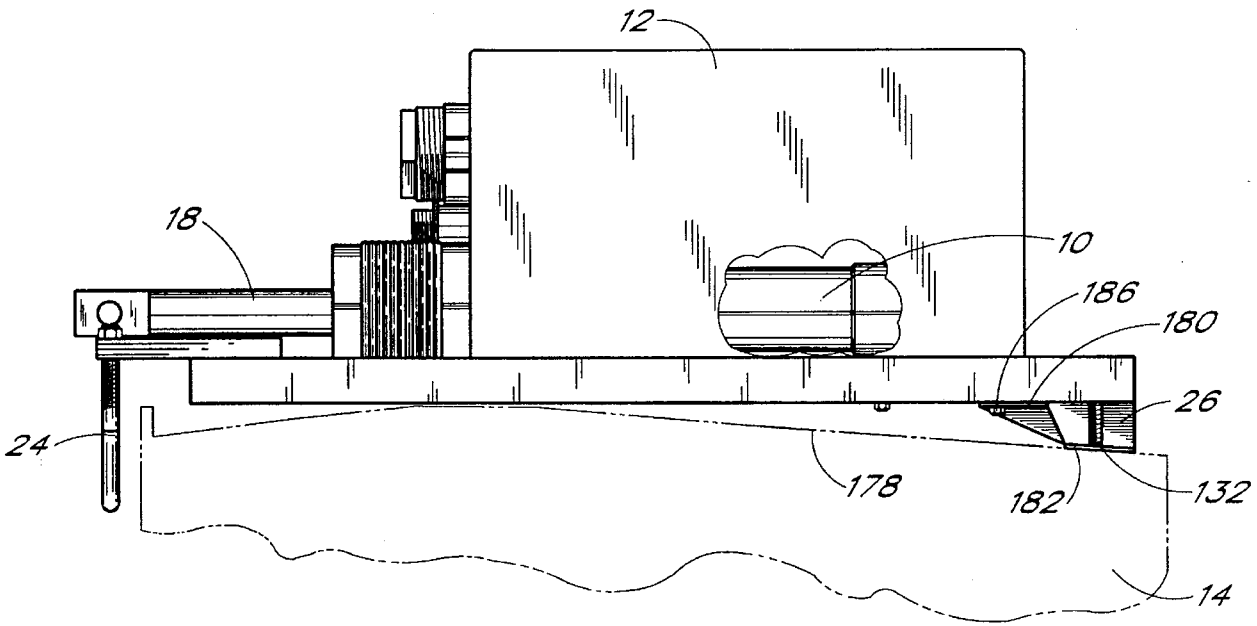
FIG. 5 is a schematic side elevational view of a rear mount used to support the actuator housing assembly of FIG. 1 on a conventional power distribution switch box having a bowed upper surface.
Figure 7:
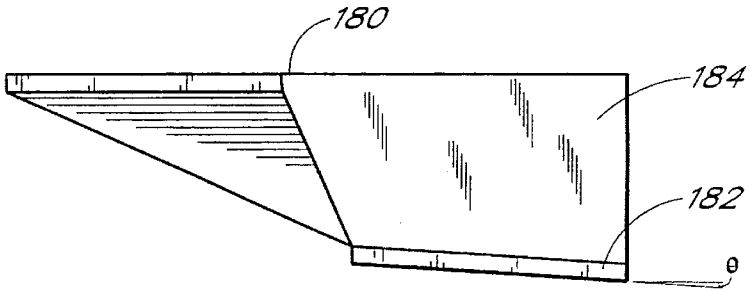
FIG. 7 is a side elevational view of the rear mount of FIG. 5.
Figure 6:
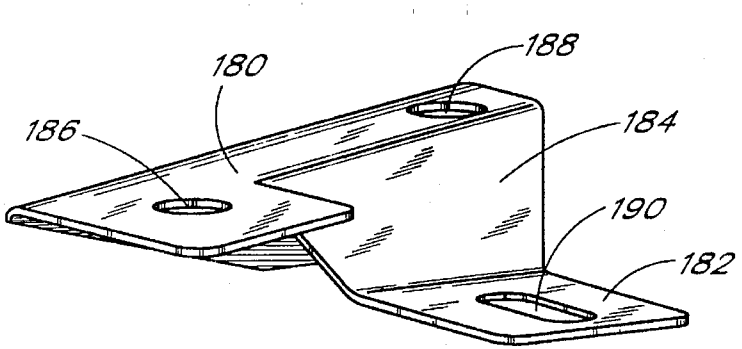
FIG. 6 is a top perspective view of the rear mount of FIG. 5.

FIGS. 5 through 7 illustrate the rear mount 26. The rear mount 26 enables the strong back 42 to be attached to the upper surface 178 of the switch box 14 in cases where the upper surface 178 bows outwardly, as schematically illustrated in FIG. 5.

FIG. 6 illustrates that the rear mount 26 comprises a platform 180 supported by a pair of feet 182. A pair of strut-like elements 184 connect the platform 180 to the feet 182.

The platform 180 has a sufficient size to support the rear end 128 of the strong back 42. The platform 180 includes a front hole 186 positioned to correspond with the rear bracket hole 136 of the strong back base plate 122. The platform 180 also includes a rear hole 188 positioned to correspond with the rear mount hole 134 of the strong back base plate 122. The platform 180 has an "L" shape. The position of the rear hole 188 desirably coincides with the center line of the rear mount 26. The front hole 186 is positioned off to the side, in the lateral direction, of the center line. The distance in the lateral direction between the front hole 186 and the rear hole 188 desirably matches the distance between the rear mount hole 136 and the rear mount hole 134 of the base plate 122.

The feet 182 extend outwardly from the center line of the rear mount 26. The feet 182 desirably have a sufficient size to stabilize the rear end 128 of the housing 12 when attached to the switch box 14. Each foot 182 defines a slot 190 sized to receive the corresponding mounting stud 132 (see FIG. 5) of the switch box 14. The spacing between the slots 190 desirable corresponds to the spacing between the mounting studs 132, and preferably matches the spacing between the rear slots 130 of the strong back 42.

The strut-like elements 184 support the platform 180 above the feet 182. These elements 184 desirably have a generally rectangular, plate-like configuration and, as viewed in the transverse direction, extend generally normal to the platform 180 and to the feet 182. As best seen in FIG. 7, the feet 182, as attached to these elements 183, are skewed relative to the platform 180. The incline angle θ by which the feet 182 are skewed preferably ranges between 1° and 30°, and more preferably equals about 3° to 4°. It is contemplated, however, that the incline angle can readily be customized to suit specific installation requirements.

The rear mount 26 is desirably stamped from a sheet of rigid material having a sufficiently large yield strength to withstand the stresses and moments placed upon it as a result of actuator actuation. The rear mount 26 is preferably formed of a metal alloy and more preferably a corrosion resistant alloy, such as, for example, 11 GA PL Stainless Steel. It is contemplated, however, that the rear mount 26 can be constructed in any of a variety of way which will be well known to one of skill in the art.

POSITION-SENSING DEVICE AND CONTROL SYSTEM

As noted above, the actuator assembly 8 can include a position-sensing device 33 that senses the location of the actuator rod 18 and communicates with the control card 32 to provide feed-back information as discussed below. It is preferred that the actuator rod 18 carry a reference member which the position-sensing device 33 can track to generate a signal indicative of the extent of actuator rod movement.

Figure 8A:
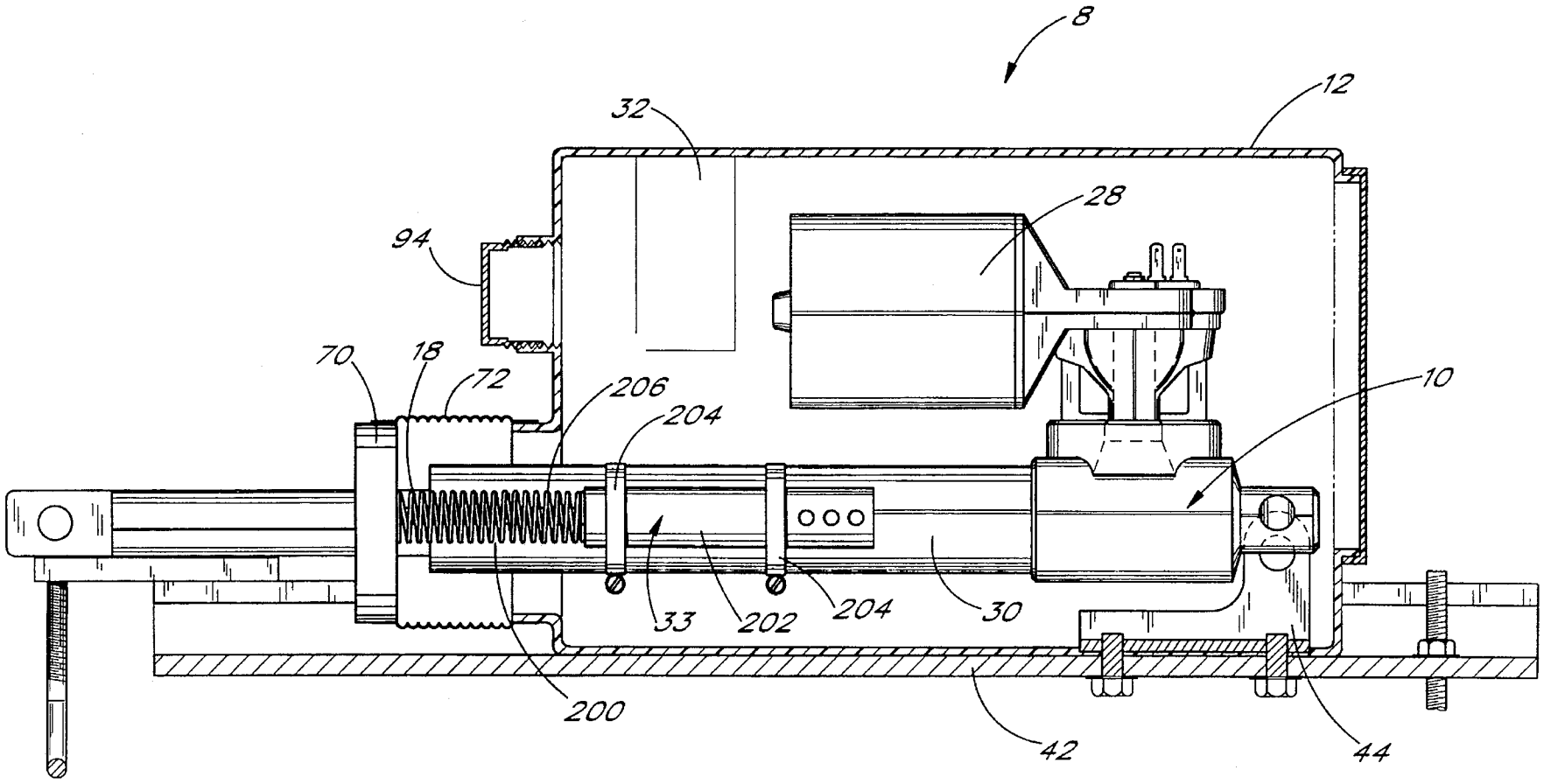
FIG. 8A is a sectional side elevational view of the actuator assembly of FIG. 1, illustrating a position-sensing device with the actuator in a closed position.

In the illustrated embodiment, as best seen in FIG. 8A, the annular collar 70 is used as the reference member. It is contemplated, however, that the reference member could comprise a separate element from the annular collar 70, and could be either a radially projecting element or a marking on the surface of the actuator rod 18.

The position-sensing device 33 desirably detects the position of the reference member (e.g., the annular collar 70) relative to the actuator body 30. In the illustrated embodiment, the position-sensing device 33 is a linear potentiometer. It is preferred that the linear potentiometer 33 be a wire-wound, analog potentiometer, such as the type available commercially as type M1310 linear motion from Maurey Instrument Corp. of Chicago, Ill.; however, it is understood that a solid state potentiometer could be used as well. It is further contemplated that other types of sensing devices 33 also could be used. For example, the position-sensing device 33 could be an optical linear encoder, a rotary potentiometer or a pull-string type rotary encoder as well.

In the illustrated embodiment of FIG. 8A, the potentiometer 33 includes a slidable ground shaft 200 which extends from a tubular housing 202 of the potentiometer 33. The ground shaft 200 has an electrical travel greater than the travel of the actuator shaft 56 between the furthest positions (i.e., the open and closed positions) of the switch lever 20. That is, the ground shaft 200 has a length and a travel sufficient to remain in contact with a wiper (not shown) of the potentiometer 33 as the actuator shaft 56 moves the distribution switch 14 between the open and closed positions. In an exemplary embodiment, the ground shaft 200 has an electrical travel generally equal to about 4.0 inches.

As best illustrated in FIG. 8A, a pair of conventional clamps 204 secure the potentiometer 33 to the actuator body 30. A biasing member 206, such as, for example, a helical compression spring, biases the front end of the ground shaft 200 of the potentiometer 33 against the annular collar 70. In this manner, the ground shaft 200 moves with the annular collar 70, as described below. It should be understood, however, that the ground shaft 200 could be attached or coupled to the annular collar 70 (i.e., the reference member) by other known connectors or conventional means.

Figure 9:
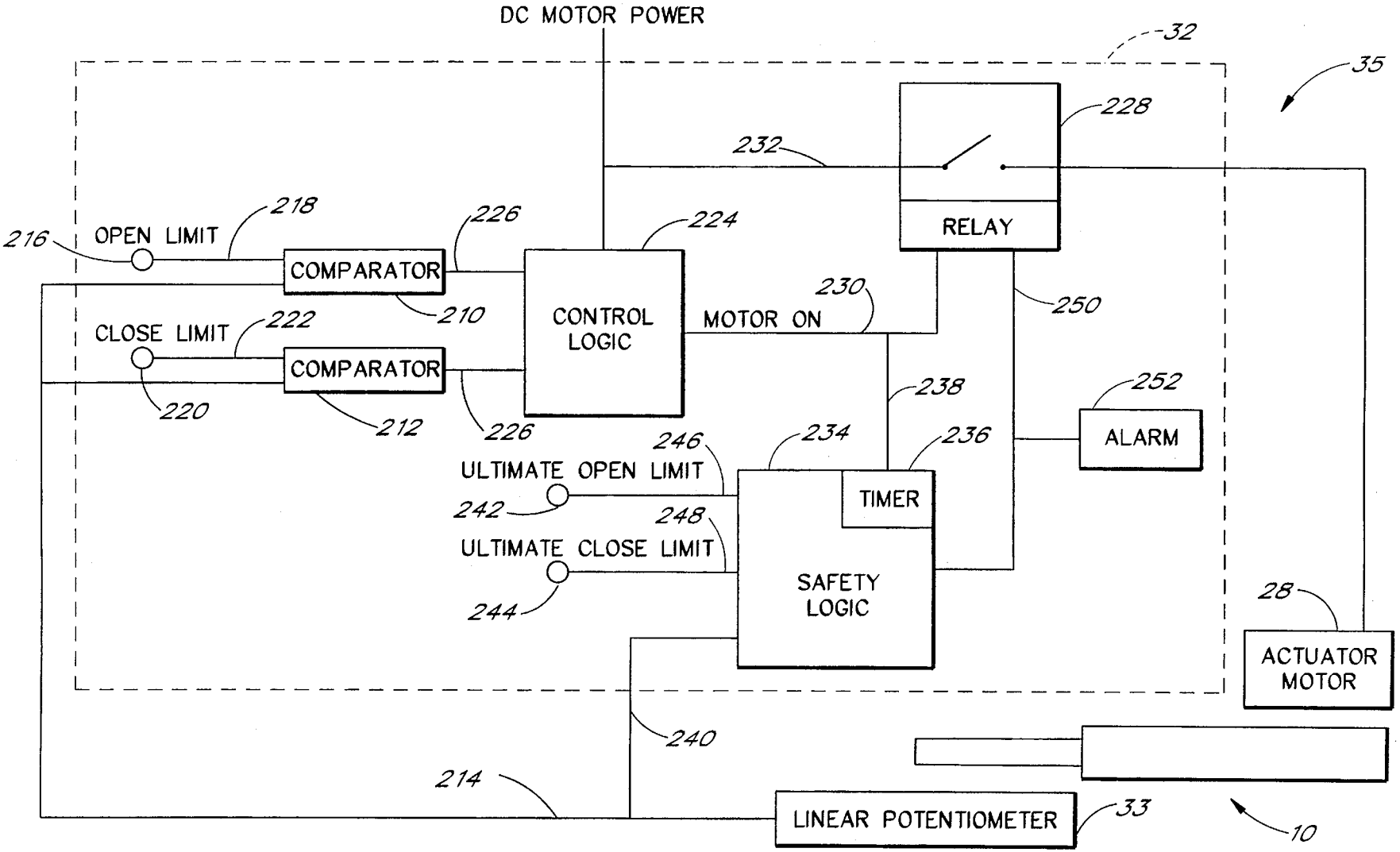
FIG. 9 represents a generalized block diagram of a control system which includes the position-sensing device of FIG. 8A.

FIG. 9 illustrates a generalized block diagram of the control system 35 formed by the position-sensing device 33 and the control card 32. As illustrated in this figure, the control card 32 includes a first comparator 210 and a second comparator 212, each of which are connected to the position-sensing device 33 by a signal line 214. The signal line 214 carries the output signal generated by the position-sensing device 33 to each comparator 210, 212 as an input signal.

The control card 32 also includes an adjustable open limit potentiometer 216 which can be adjusted to control the open position of the actuator 10. That is, the open limit potentiometer 216 sets the open limit or "stop" for the travel of the actuator 10. An open limit signal line 218 connects the open limit potentiometer 216 to the first comparator 210.

The control card 32 also includes an adjustable closed limit potentiometer 220 which is used to set the closed limit for the travel of the actuator 10. A closed limit signal line 222 connects the closed limit potentiometer 220 to the second comparator 212.

Each comparator 210, 212 compares the signal from the position-sensing device 33 with the signal from the corresponding limit potentiometer 216, 220 and generates a comparison signal. Each comparator 210, 212 communicates with a control logic 224 of the control card 32 via a signal line 226. The control logic 224 receives the comparison signals from the comparators 216, 220 as input signals.

The control logic 224 also receives an input from a power supply (not shown). The power supply is selectively coupled to the control logic 224 by a known remote terminal unit (not shown), as discussed below.

The control logic 224 communicates with a relay 228 via a motor-on signal line 230. The control logic 224 selectively generates a motor-on output signal which is carried by the motor on signal line 230 and is received by the relay 228. In this manner, the control logic 224 controls the operation of the relay 228.

The relay 228 is positioned in a power supply line 232 which connects the actuator motor 28 to the power supply (not shown). In the illustrated embodiment, the power supply line 32 carries DC power.

The control card 32 also includes safety logic 234 which produces an override control signal which disconnects the actuator motor 28 from the DC power supply (not shown) if the actuator motor 28 has been energized for a period of time which exceeds a preselected time period, or has been actuated beyond the open or closed travel limit set by the open limit potentiometer 216 and the closed limit potentiometer 220. For this purpose, the safety logic includes a timer 236 which receives the control signal from the control logic 224 via a sample signal line 238. The safety logic 234 also receives an input signal from the position-sensing device 33 via a signal line 240, as well as signals from an ultimate open limit circuit 242 and an ultimate closed limit circuit 244 carried by a first signal line 246 and a second signal line 248, respectively. The safety logic 234 can generate the overriding output control signal carried by an override signal line 250 to the relay 228. This output control signal can also be received by an alarm 252 which alerts of the actuator malfunction.

ACTUATOR/HOUSING ASSEMBLY

FIGS. 1, 2 and 8A illustrate the actuator assembly 8. When assembled, the enclosure 40 of the housing 12 is slid between the rails 120 of the strong back 42 with the bottom panel 110 of the enclosure 40 sitting on the base plate 122. As best seen in FIG. 2, the enclosure 40 is slid between the rails 120 to a position in which the holes 112 in the bottom panel 110 align with the corresponding holes 136 in the base plate 120 of the strong back 42.

As seen in FIG. 3, the horizontal member 124 of each rail 120 inserts into the corresponding groove 108 of the enclosure 40 to interconnect the strong back 42 and the enclosure 40 in a tongue-and-groove-like manner. The bottom panel 110 of the enclosure 40 sits generally flush against the base plate 122. The rails 120 capture the lower portion of the side walls 80 of the enclosure 40.

FIG. 2 illustrates the bracket 44 assembled with the enclosure 40 and strong back 42. The bracket 44 is inserted into the interior cavity 82 of the enclosure 40. The studs 146 of the bracket 44 are inserted through the aligned holes 112, 136 of the enclosure bottom panel 110 and the base plate 122. The bracket base 140 preferably sits within the recess 114 of the enclosure bottom panel 110. Nuts 192 are threaded on the studs 146 to secure the bracket 44 to the strong back 42. The enclosure bottom panel 110 is interposed between the bracket base 140 and the base plate 122. O-rings or washers (not shown) are preferably positioned over the studs 146 between the bracket base 140 and the enclosure bottom panel 110 to seal the holes 112 in the bottom panel 110.

The actuator 10 is inserted through the rear opening 102 of the enclosure 40 and into the interior cavity 82. As seen in FIG. 2, the front end of the actuator cylinder 30 and rod 18 are extended through the central opening 98 in the front panel 86 of the enclosure 40. The actuator support stud 50 is positioned between the legs 142, 144 of the bracket 44, and the actuator 10 is rotated to align the aperture 52 of the support stud 50 with the holes 150 in the bracket legs 142, 144. A pin (not shown) is inserted through the aligned holes 52, 150 to fix the support stud 50 to the bracket 44.

As mentioned above, the axis of holes 150 of the bracket 44 is preferably slanted relative to the base 140 so as to position the actuator 10 within the enclosure 40 at a slight angle. So positioned, the transverse height of the enclosure 40 can be reduced to decrease material costs. The actuator 10 is preferably skewed relative to the transverse axis by about 15°.

The extender 54 is threaded onto the actuator rod 18, with the collar 70 interposed therebetween. As seen in FIG. 2, the extender 54 preferably extends beyond the front edge 138 of the strong back 42 when attached to the actuator rod 18.

As best seen in FIG. 8A, the position-sensing device 33 is desirably attached to the actuator body 30 with its ground shaft 200 extended to the annular collar 70. The clamps 204 secure the position-sensing device 33 in this position. The biasing member 206 biases the front end of the ground shaft 200 against the collar 70. For this purpose, the biasing member 206 is attached to the front end of the ground shaft 200 with the shaft 200 passing through the biasing member 206. The rear end of the biasing member 206 abuts against the front end of the potentiometer housing 202 at the point from which the ground shaft 200 extends.

With reference back to FIG. 2, the bellow 72 is positioned between flange 99 of the enclosure central opening 98 and the collar 70. The bellow 72 desirably has an inner diameter substantially equal to the outer diameter of the annular flange 99 and of the collar 70. A forward end of the bellow 72 slips over the collar 70, and the rear end of the bellow slips over the flange 99.

The bellow 72 is preferably formed of a flexible material, such as, for example, an elastomer. It is also desired that the material of the bellow 72 maintain its structural integrity when used in its intended environment. In an exemplary embodiment, a suitable bellow 72 can be obtained commercially from A & A Co., Part No. Q-108290.

Connectors (not shown), such as, for example, hose clamps, available commercially from McMaster-Carr, secure the front end of the bellow 72 to the collar 70 and the rear end of the bellow 72 to the flange 99. The bellow 72 thus can contract and expand as the actuator rod 18, to which the collar 70 is attached, slides in and out of the enclosure 40. In this manner, the bellow 72 seals the central opening 98 between the flange 99 and the collar 70 attached to actuator rod 18.

FIG. 3 illustrates that the rear cap 106 snaps over the flange 104 of the rear access opening 102 to cover the opening 102. A connector (not shown), such as, for example, a hose clamp, available commercially from McMaster-Carr, secures the cap 106 on the flange 104.

As illustrated in FIGS. 1 and 2, the housing/actuator assembly is desirably installed on the upper surface 178 of the switch box 14. FIG. 2 best illustrates that the rear end 128 of the strong back 42 is positioned over the mounting studs 132 which extend through the slots 130 in the base plate 122. Nuts 194 are threaded onto the mounting studs 132 and are tightened to attach the rear end 128 of the strong back 42 to the switch box 14.

FIG. 1 illustrates that the front edge 138 of the strong back 42 rests proximate to a front surface 196 of the switch box 14. The support arm 152 advantageously extends slightly beyond the front surface 196 of the switch box 14 at a position just off to the side of the lever 20, in the lateral direction.

FIG. 1A illustrates the front mounting attachment which secures the strong back 42 to the switch box 14. The clamp 24 is positioned over the lever 20 from the bottom side to capture at least the lower edge of the lever 20 in this position. The clamp 24 desirably is positioned adjacent to the front surface 196 of the switch box 14.

The ends of the U-shaped clamp 24 are inserted through the corresponding holes 156 of the support arms 152. Nuts 176 are then threaded on the ends of the clamp 24 and tightened. As the nuts 176 are tightened, the clamp 24 pulls the support arm 152 towards the lever 20. The nuts 176 are tightened until the front edge 138 of the strong back 42 securely sits against the top surface 178 of the switch box 14. The clamp 24 cannot be removed from the level 20 without loosening the nuts 176.

If the top surface 178 of the switch box 14 is severely bowed, as illustrated in FIG. 5, the rear mount 26 can be used to secure the rear end 128 of the strong back 42 to the switch box 14. The rear mount 26 acts as a wedge placed between the strong back 42 and the switch box 14 to stabilize the housing 12.

As seen in FIG. 5, the rear mount 26 is attached to the bottom side of the strong back 42. The front hole 186 of the rear mount 26 is inserted over the rear stud 146 of the bracket 44. The nut 192 threads on the stud to interconnect the rear mount 26 and the strong back 42, as well as to interconnect the bracket 44 and the strong back 42. The rear hole 188 of the rear mount 26 is aligned with the rear mount hole 134 of the strong back 42. A bolt (not shown) is inserted through the aligned holes 188, 134 and attached via a nut (not shown).

The mounting studs 132 of the switch box 14 extend through the slots 190 of the feet 182 of the rear mount 26 and through the slots 130 of the base plate 122 when the strong back 42 is positioned on the switch box 14. The strong back 42 is then attached to the switch box 14, as described above.

The interconnection between the connector 96 and a conventional corresponding receptacle connector (not shown) connects the control electronics 32 and the actuator 16 to an electrical power source and to communication lines. The connector 96 desirably is connected to both a main source of electricity, as well as an auxiliary source of electricity. The connector also is connected to a communication line which links the control card 32 to the central control system.

A technician can adjust the travel of the actuator 10 by removing the plug 94 from the access hole 88 in the front panel 86. The technician may then adjust the potentiometers 216, 220 on the control card 32 to achieve the travel required to move the lever 20, and thereby throw the switch 16.

The housing 12 completely seals the actuator 10 and control electronics 32 from the surrounding environment. The seals across the rear opening 102, central opening 98 and access opening 88 are advantageously fluid-tight, so that the housing 12 can be submerged.

ACTUATION OF THE POWER DISTRIBUTION SWITCH

Figure 8B:
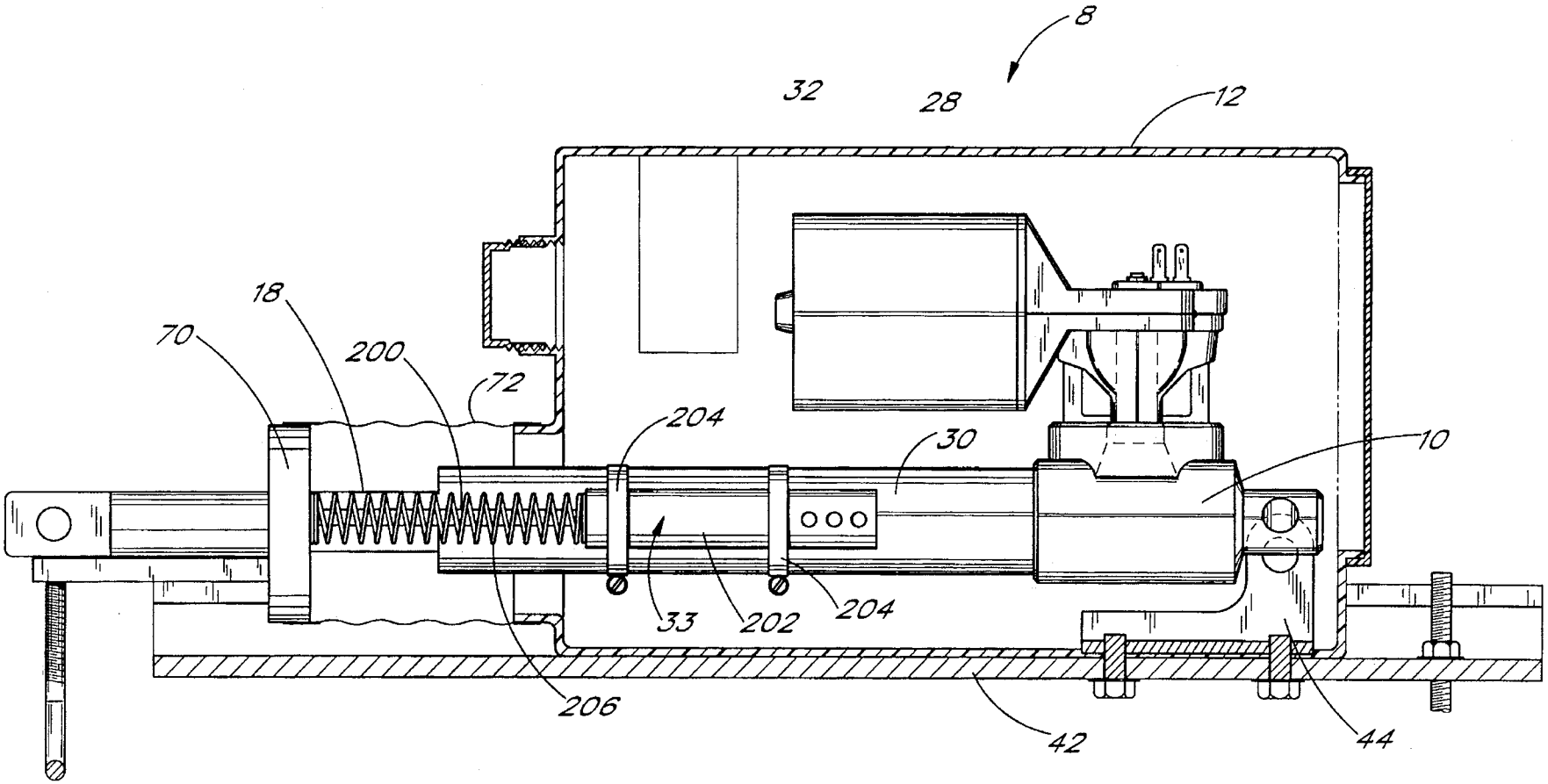
FIG. 8B is a sectional side elevational view of the actuator assembly of FIG. 8A with the actuator in an open position.

The following elaborates on the previous description of the actuation of the linear actuator 10 and the coupled power distribution switch 12 with primary reference to FIGS. 8A, 8B and 9.

FIG. 8A illustrates a side sectional view of the actuator assembly 8 with the actuator 10 in the closed position. The ground shaft 200 of the position-sensing device 33 extends from the body 202 of the position-sensing device 33 to the annular collar 70. The biasing member 206 biases the shaft 200 in this position.

When the central control system (not shown) instructs the remote terminal unit (not shown) to throw a specific power distribution switch 12, the remote terminal unit couples the corresponding control card 32 to a source of DC power to drive the actuator motor 28. The control card 32 in turn controls the extent of travel of the actuator 10.

With reference to FIG. 9, the control logic 224 of the control card 32 determines the position of the actuator 10 before beginning actuation. This is done by the comparison of the position signal generated by the position-sensing device 33 with the open and closed limit signals produced by the open limit potentiometer 216 and the closed limit potentiometer 220, respectively.

Each comparator 210, 212 compares the position signal sent by the linear potentiometer 33 with the corresponding limit signal, and generates an output signal which indicates whether the actuator 10 is currently in a position which corresponds to the limit stop set by the corresponding limit potentiometer 216, 220 (i.e., whether the signal from the position-sensing device 33 matches the signal from the corresponding limit potentiometer 216, 220). Each comparator 210, 212 then generates a position signal which is received by the control logic 224.

The control logic 224 determines the position of the actuator 10 from the signals. In the illustrated example with the actuator in the closed position (FIG. 8A), the second comparator 212 determines that the signal from the position-sensing device 33 matches the signal sent from the closed limit potentiometer 220. The second comparator 212 then generates an appropriate signal which the control logic 224 recognizes as indicating that the actuator 10 is in the closed position.

The control logic 224 also examines the polarity of the DC motor power carried by the power lines 232. If the polarity of the DC power will drive the actuator motor 28 in the proper direction (i.e., drive the actuator 10 from the initial closed position to the open position), the control logic 224 generates a motor control signal which activates the relay 212 and connects the actuator motor 28 to the DC power supply (not shown).

The actuator motor 28, when energized, drives the actuator 10 to extend the actuator rod 18 and to place the switch level 20 (FIG. 1) in the open position. FIG. 8B illustrates the actuator 10 extended to the open position. The biasing member 206 forces the ground shaft 200 of the position-sensing device 33 to move with the annular collar 70 as the actuator rod 18 moves from the closed position (i.e., the retracted position) to the open position (i.e., the extended position).

With reference back to FIG. 9, once the actuator 10 reaches the open position as set by the open limit potentiometer 220, the first comparator 210 signals the control logic 224 to indicate the change in the position of the actuator 10. The control logic 224 then disables the relay 228 to disconnect the actuator motor 28 from the DC motor power. At this point, the actuator 10 stops.

The safety logic 234 monitors the actuator 10 for malfunctions. Specifically, the timer 236 of the safety logic 234 times the period of time for which the actuator motor 28 is energized. If the time period exceeds a preselected time period, as would be the case if the actuator 10 gets stuck between the open and closed positions, the safety logic 234 disables the relay 228 to disconnect the actuator motor 228 from the DC motor power. The safety logic 234 also activates the alarm 252 to alert an operator of the malfunction.

The safety logic 232 also compares the position of the actuator 10 with preselected ultimate open and closed positions. If the actuator 10 reaches a preselected ultimate open or closed position, as set by the ultimate open limit circuit 242 or the ultimate closed limit circuit 244, the safety logic 234 disables the relay 228 to disconnect the actuator motor 28 from the DC motor power. It should be appreciated that the ultimate limit positions are set beyond the open limit position and the closed limit position established by the potentiometers 216, 220, respectively. Thus, if the actuator 10 extends beyond the "stop" established by the open and closed limit potentiometers 216, 220, the safety logic 232 would disable the actuator 10 once the actuator 10 reached an ultimate open position or an ultimate closed position so as not to damage the actuator 10 or the corresponding power distribution switch 12. The safety logic 234 also activates the alarm 252 to alert the operator of the malfunction.

When actuated, the actuator 10 exerts a load on the bracket 44. As discussed above, the load is carried by the bracket 44 and the strong back 42 attached to the switch box 14. It has been determined that the enclosure 40 is generally isolated from the load. The enclosure 40 can thus be made of a lighter, less expensive material than the prior metal enclosures to reduce manufacturing costs. Additionally, the plastic enclosure generally seals the actuator within its interior cavity and is substantially corrosive-resistant.

Although this invention has been described in terms of a certain preferred embodiment, other embodiments apparent to those of ordinary skill in the art are also within the scope of this invention. Accordingly, the scope of the invention is intended to be defined only by the claims which follow.

What is claimed is:

1. An actuator assembly for use with a power distribution switch of the type used with an electrical utility power grid, the distribution switch being movable to establish at least a first and a second power routing condition, said actuator assembly comprising:

an actuator having a body and an actuator shaft adapted to be coupled to a lever of the power distribution switch, said actuator shaft sliding relative to said body between at least a first position, in which the lever of the power distribution switch is positioned to establish said first power routing condition, and a second portion, in which the lever of the power distribution switch is positioned to establish said second power routing condition, said actuator shaft carrying a reference member; and a position-sensing device attached to said actuator, said sensing device generating a signal indicative of movement of said reference member as said actuator shaft moves between said first and second positions.

2. The actuator assembly of claim 1, wherein said position-sensing device generates a signal indicative of the extent of displacement of said reference member relative to said actuator body.

3. The actuator assembly of claim 1, wherein said position-sensing device comprises a linear potentiometer which includes a wiper coupled to a finger that moves with said reference member carried by said actuator shaft.

4. The actuator assembly of claim 3, wherein said position-sensing device additionally comprises a biasing member positioned to bias said fingers of said potentiometer against said reference member of said actuator shaft.

5. The actuator assembly of claim 3, wherein said potentiometer includes a body that houses said wiper, said body being attached to said actuator body.

6. The actuator assembly of claim 1 additionally comprising comparator circuitry which compares said signal indicative of the motion of said reference member to a preselected signal indicative of a desired actuator stop point to determine whether the actuator travel has reached the desired stop point.

7. The actuator assembly of claim 1, wherein said position-sensing device is a wire-wound, analog, linear potentiometer.

8. The actuator assembly of claim 1, wherein said reference member comprises a radially extending projection attached to said actuator shaft.

9. The actuator assembly of claim 8, wherein said reference member comprises an annular collar which circumscribes said actuator shaft.

10. The actuator assembly of claim 9, additionally comprising a housing having a body which encloses at least a portion of said actuator with said actuator rod projecting beyond said housing, said housing further including an expandable bellow which extends between said housing body and said annular collar so as to seal said portion of said actuator within said housing body.

11. The actuator assembly of claim 1, additionally comprising a housing having a body which encloses at least a portion of said actuator with said actuator shaft sliding relative to said body through an aperture of said body.

12. The actuator assembly of claim 11, wherein said housing additionally includes a bellow which extends between said body and said actuator shaft to generally seal said aperture of said body, said bellow adapted to expand and to contract as said actuator shaft moves between said first and second positions.

13. The actuator assembly of claim 12, wherein said reference member comprises an annular collar which circumscribes said actuator shaft with one end of said bellow connected to said annular collar.

14. A method of controlling the position of a power distribution switch between at least two power routing conditions, comprising the steps of:

coupling an actuator shaft to the power distribution switch such that movement of said actuator shaft moves a lever of the power distribution switch;

attaching a reference member to said actuator shaft;

moving said actuator shaft to throw the power distribution switch;

continuously detecting the movement of the reference member as the actuator shaft moves;

generating a signal indicative of the movement of the reference member;

communicating said signal to control circuitry; and comparing said signal to a preselected signal indicative of a desired actuator stop point to determine whether the actuator travel has reach the desired stop point.

15. An actuator assembly for use with a power distribution switch of the type used with an electrical utility power grid, the distribution switch having a movable lever, said actuator assembly comprising a motor which moves a linear actuator through a drive train, said actuator having a body and an actuator shaft, said actuator shaft moving relative to said actuator body between a first position and a second position with an end of the actuator shaft being adapted to be coupled to the lever of the power distribution switch, control logic driving said motor, and a sensor continuously detecting an electrical characteristic, independent of the motion transferred through said drive train, as said actuator shaft moves between said first and second positions, said electrical characteristic being indicative of the extent of displacement of said actuator shaft relative to said actuator body, said sensor generating a signal indicative of the position of said actuator shaft relative to said actuator body, said control logic receiving said signal from said sensor.

16. An actuator assembly as in claim 15, wherein said sensor is adapted to detect changes in electrical resistance.

17. An actuator assembly as in claim 16, wherein said sensor comprises linear potentiometer which includes a wiper coupled to a finger, said finger cooperating with said actuator shaft such that said finger and said actuator shaft move together generally in parallel.

18. An actuator assembly as in claim 17, wherein said actuator shaft carries a reference member and said sensor additionally comprises a biasing member positioned to bias said fingers of said potentiometer against said reference member.

19. An actuator assembly as in claim 18, wherein said reference member comprises an annular collar which circumscribes said actuator shaft.

20. An actuator assembly as in claim 17, wherein said potentiometer includes a body that houses said wiper, said body being attached to said actuator body.

21. An actuator assembly as in claim 15, wherein said control logic comprises comparator circuitry which compares said signal indicative of the movement of said actuator shaft to a preselected signal indicative of a desired actuator stop point to determine whether the actuator travel has reached the desired stop point.

* * * * *